United States Patent [19]

McBride et al.

[11] Patent Number: 4,861,278

[45] Date of Patent: Aug. 29, 1989

[54] CONNECTOR FOR DROP WIRE AND OTHER CONDUCTORS

[75] Inventors: Antoinette D. McBride, Milford; Arnold R. Smith, Chester, both of N.J.

[73] Assignee: American Telephone and Telegraph Company AT&T Bell Laboratories, Murray Hill, N.J.

[21] Appl. No.: 186,335

[22] Filed: Apr. 26, 1988

[51] Int. Cl.[4] ..... H01R 4/24

[52] U.S. Cl. ..... 439/395; 439/402; 439/596

[58] Field of Search ..... 439/467, 544, 549, 557, 439/389–419, 596

[56] References Cited

U.S. PATENT DOCUMENTS

| | | | |
|---|---|---|---|
| 3,836,696 | 9/1974 | Gressitt et al. | 174/41 |
| 3,899,236 | 8/1975 | Santos | 439/402 |
| 3,912,356 | 10/1975 | Johaneson | 439/400 |
| 3,960,431 | 8/1976 | MacKenzie | 439/399 |
| 4,138,184 | 2/1979 | Knopp | 439/399 |
| 4,195,194 | 3/1980 | Kuster et al. | 439/391 |
| 4,324,450 | 4/1982 | Weisenburger et al. | 339/99 R |
| 4,564,256 | 1/1986 | Damiano et al. | 439/396 |
| 4,749,365 | 6/1988 | Magnifico et al. | 439/396 |
| 4,759,725 | 7/1988 | Finch | 439/557 |

FOREIGN PATENT DOCUMENTS

| | | | |
|---|---|---|---|
| 1026206 | 6/1983 | U.S.S.R. | 439/396 |

*Primary Examiner*—David Pirlot
*Attorney, Agent, or Firm*—R. F. Kip, Jr.

[57] ABSTRACT

The connector comprises a plastic holder which carries two wires leads and serves as a cap for the free end of a drop wire inserted thereunto. Two metal contacts received in slots in the holder are driven in by pliers action to pierce the insulation of the leads and drop wire and to each engage both the conductor of a respective lead and a respective conductor of the drop wire to thereby electrically connect these two conductors. Next, plastic covers for the contacts, hinged to and integral with the holder, are closed to become locked thereto. The connection is then adapted to serve as a plug for an aperture in a terminal box, and to be attached thereto by snap action, and to have its leads connected to terminals in the box.

23 Claims, 12 Drawing Sheets

CONNECTOR FOR DROP WIRE AND OTHER CONDUCTORS

TECHNICAL FIELD

This invention relates generally to electrical connectors adapted for use with wires comprising electrical conductors and insulation therefor to pierce the insulation of such a wire, and to electrically connect its one or more conductors to, respectively, one or more points outside that wire. More particularly, this invention relates to connectors of such kind designed to be affixed to a drop wire and to electrically connect the two conductors of such wire to terminals outside a house or other premises to which such drop wise extends.

BACKGROUND OF THE INVENTION

U.S. Pat. No. 4,324,450, issued Apr. 13, 1982 in the name of L. P. Weisenburger et al. to AMP Inc. discloses a connector device adapted for use with a drop wire comprising two separated multistrand electrical conductors and an insulating sheath or jacket within which such conductors extend. The device is made from a longitudinally elongated piece of sheet metal bent in the vertical-longitudinal plane into a "U" shape to have upper and lower horizontal arms integrally joined at their rear by a deformable bridge section. Each of such arms has at its front on its laterally opposite sides a pair of vertical plates projecting toward the other arm and having formed therein respective open ended notches extending into such plates from their forward margins. The notches have tapered entrances which are convergent from such margins, and which have cutting edges on the sides of such entrances. The plates on the upper arm are spaced laterally outward of those on the lower arm to permit the upper and lower pairs of plates to pass by each other with clearance. The connector has at its rear a laterally-central longitudinally-elongated slot extending from a rounded horizontal end therefor in the upper arm over the entire vertical extent of the bridge section to an opposite rounded horizontal end in the lower arm. The slot at its two rounded ends provides two vertically aligned horizontal openings which together provide vertical passage through the device.

In the operation of the device, a drop wire is positioned between its upper and lower arms so that they straddle a half of the drop wire's cross-section contanining one of its conductors. Pliers are then applied to the device to inelastically deform the bridge section of the device, and to force towards each other the plates on its arms so as to receive such half of such drop wire in the notches in the plates. Further squeezing by the pliers causes the cutting edges in the notches in the plates to pierce the insulation of the wire and to provide a maintained electrical contact between the conductor in such drop wire half and each of the plates. With the front of the device thus being clamped onto the drop wire, the device is manipulated to pass through the passage at its rear a binding post upstanding from a terminal block. A nut is then screwed onto the post to hold the device fast on the block.

The aforedescribed connector has the disadvantages among others that separate devices must be used for the two conductors of the usual drop wire, and that the need to mount such two devices on such posts can make it awkward for the two conductors of the wire of choice to be respectively connected to two binding posts at different spaced apart locations.

SUMMARY OF THE INVENTION

In contrast, an electrical connector according to the invention in one of its aspects comprises an insulative holder for a drop wire inserted therein, a pair of flexible wire leads each comprising a conductor and insulation therefor, and each having a first end proximate said holder and a second end attachable to a respective one of two terminals, and a pair of metal contact means movably received in said holder and each being disposed at the first end of a respective one of said leads. Each of such metal contact means is adapted by externally applied force thereon to be driven into said holder to pierce the insulation of said drop wire and to electrically interconnect the conductor of such lead and a respective one of the two conductors in said drop wire.

Such connector is accordingly a single device adapted to effect electrical interconnection of both of the two conductors of the drop wire. Moreover, because the mentioned wire leads are elongated and flexible such connector is adapted to connect such two conductors to respective terminals therefor without the positioning of such conductors for such connecting purposes being determined to a large degree by the positioning of such terminals.

It is to be appreciated that electrical connectors according to the invention in other of its aspects may comprise one or more features other than those described above.

BRIEF DESCRIPTION OF THE DRAWING

For a better understanding of the invention, reference is made to the following description of an exemplary embodiment thereof, and to the accompanying drawings wherein.

In the description which follows, counterpart features may be designated by the same reference numerals with different letter suffixes, and a description of any feature so designated shall unless the context otherwise requires, be taken as equally applicable to its similarly designated counterpart.

DETAILED DESCRIPTION

Figure 1:
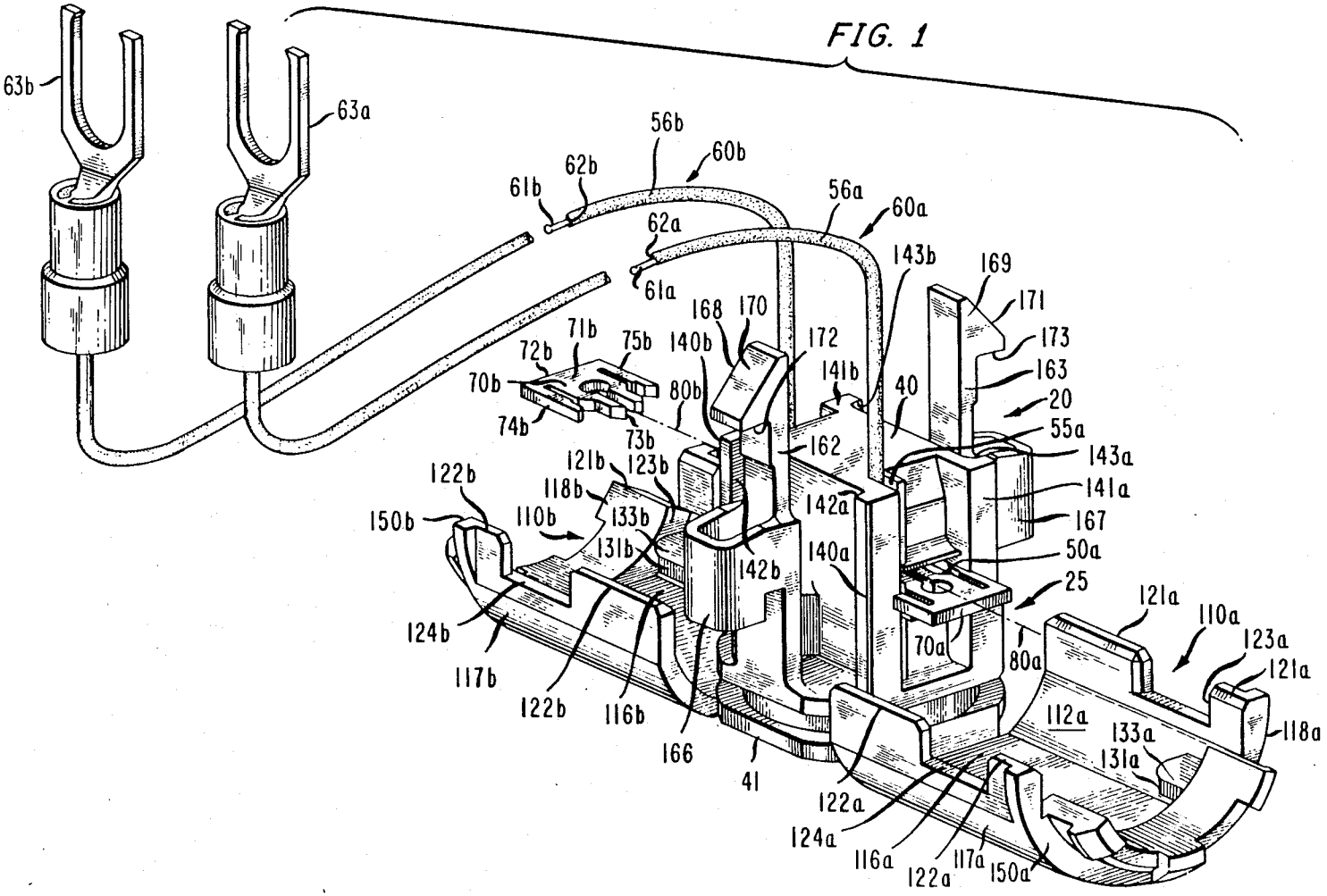
FIG. 1 is an isometric view of an electrical connector device according to the invention with the left hand one of the contacts of the device being detached from a holder therefor, and with the covers of the device being in open position.
Figure 3:
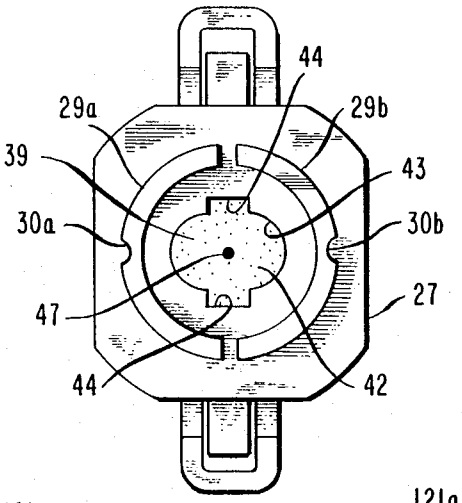
FIG. 3 is a bottom plan view of the upper of two plastic pieces included in the FIG. 1 device.
Figure 4:
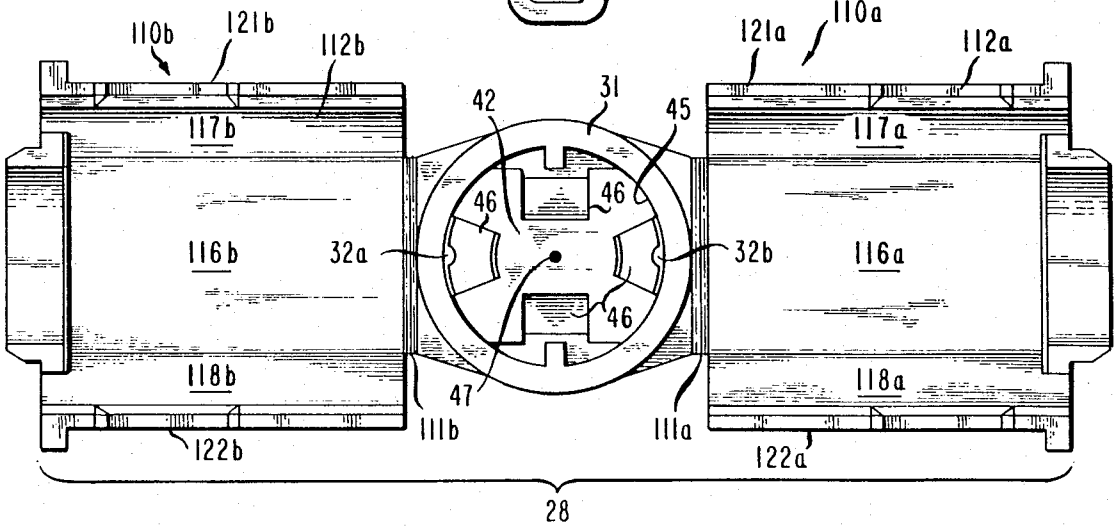
FIG. 4 is a top plan view of the lower one of such two pieces.
Figure 5:
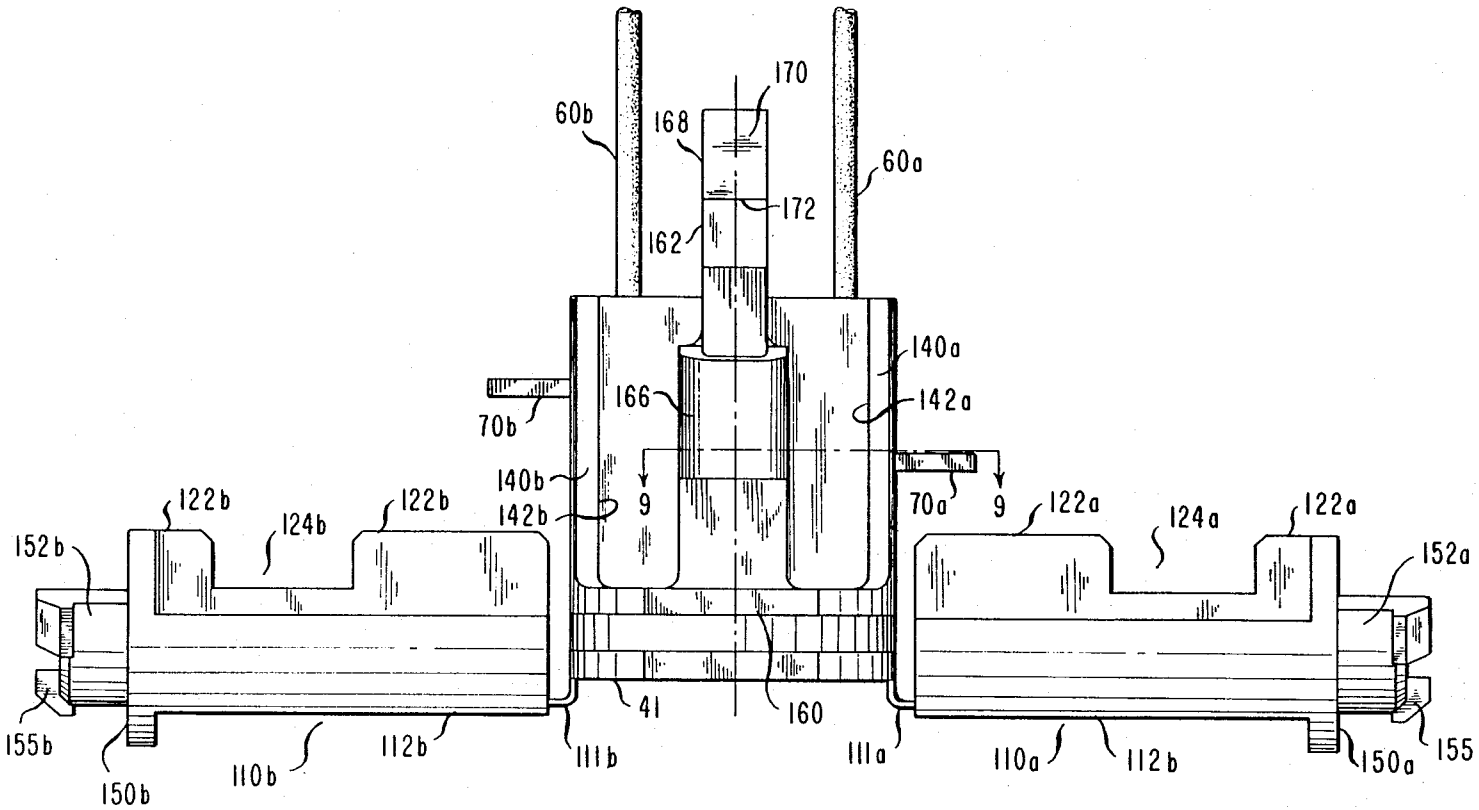
FIG. 5 is a front elevation of the FIG. 1 device with the left hand contact thereof being received in its holder.

Referring now to FIG. 1, the reference numeral 20 designates an electrical connector comprising an assembly 25 comprised of insulative synthetic resinous material. Assembly 25 is made from an upper piece 27 (FIG. 3) and a lower piece 28 (FIG. 4). Piece 27 has at its bottom a pair of projecting semiannular ribs 29*a*, 29*b* having semicircular notches 30*a*, 30*b* formed in their circumferences. Lower piece 28 has at its center an upwardly projecting annular ring 31 with a pair of semicircular tabs 32*a*, 32*b* matching notches 30*a*, 30*b* and radially salient inward from the inside periphery of such ring. Assembly 25 is fabricated from pieces 27, 28 by placing upper piece 27 on top of lower piece 28 so that ribs 29 are seated with a press fit in ring 31 (with tabs 32 being received in notches 30), and by then heating the two pieces to fuse them together into an integral unit.

Figure 2:
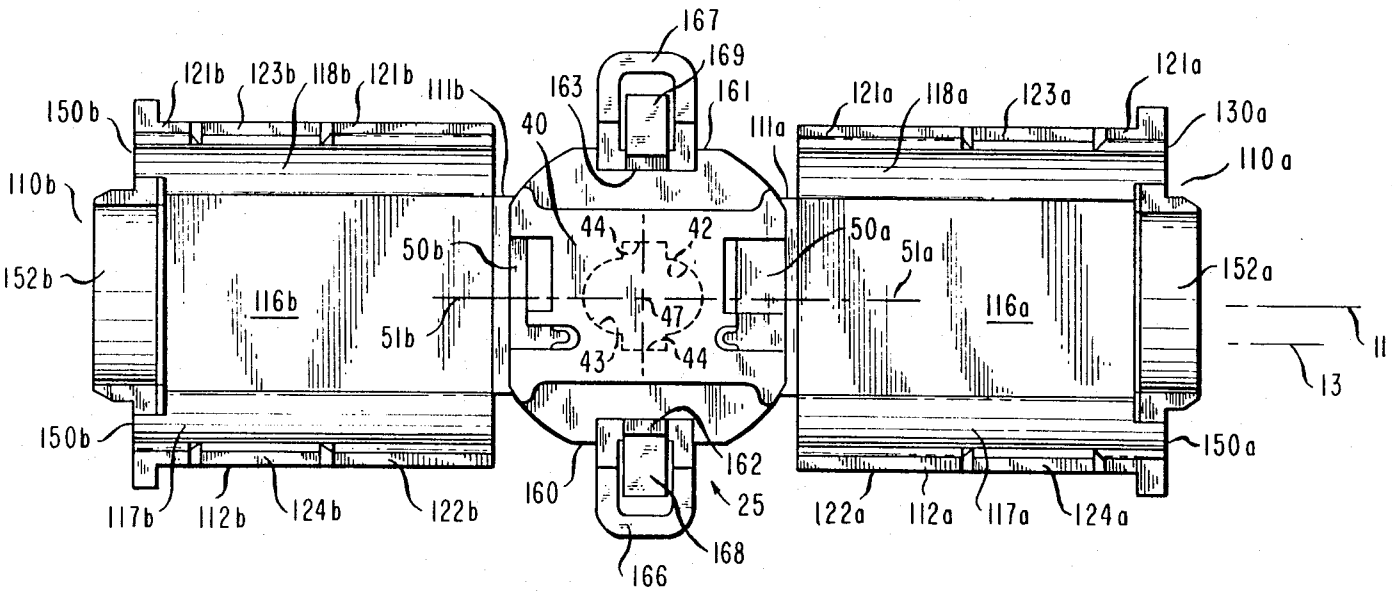
FIG. 2 is a top plan view of the FIG. 1 device (with both contacts removed)

Assembly 25 includes an upstanding holder or cap 35 for a drop wire 36 (FIG. 10) comprising a pair of spaced elongated electrical conductors 37*a*, 37*b* of copper (or other metallic material) and an insulative jacket 38 for those conductors. Cap 35 has a vertically spaced top 40 and base 41, and has extending thereinto from such base a vertical channel 42 into which is insertable a free end of the drop wire 36. Prior to connector 20 being put into use, the upper part 43 of channel 42 may be filled with a waterproofing jelly 39 (FIG. 3). In its upper part 43, channel 42 horizontally is of greater lateral than transverse dimension (FIG. 2) and is of a non-circular cross-section adapted to contain with a close sliding fit the drop wire 36 so as to restrict angular rotation thereof relative to cap 35. Within that upper part or section 43, the channel 42 has on its transversely opposite sides a pair of shallow rectangular vertical grooves 44 extending over the full length of such upper section.

For a short length of the extension of channel 42 from the base 41 of cap 35 vertically into the cap, the channel has a lower section 45 (FIG. 10) which is enlarged in size relative to the upper part 43 of the channel, and which is substantially circular in horizontal cross-section. Distributed around the periphery of channel section 45 at its bottom are a plurality of synthetic resinous tabs 46 (FIGS. 4 and 10) disposed in angularly spaced relation around the center axis 47 of channel 42 and extending with an upward slant into such channel towards such center. Tabs 46 are integral with assembly 25 and are hingedly connected at their bases to the body of such assembly so as to be resiliently deflectable vertically within the lower section 45 of the channel 42. The function of such tabs will be later explained.

Cap 35 has formed therein on laterally opposite sides of channel 42 a pair of horizontal slots 50*a*, 50*b* spaced from each other in the vertical length of the slot so that the right hand slot 50*a* (FIG. 10) is lower than the left slot 50*b*. The slots 50 pass laterally from outer openings therefore on the outside of cap 35 to respective inner openings of such slots into drop wire channel 42. As shown in FIG. 2, the two slots 50 are transversely greater in size than channel 42 which is bisected by the laterally extending axes 51*a*, 51*b* of the two slots.

Cap 35 also has formed therein, on its laterally opposite sides and towards the front of the cap, a pair of vertical grooves 55*a*, 55*b* extending from the top of cap downward to intersect and go beyond the slots 50*a*, 50*b*. Received within grooves 55*a* and 55*b* are the lower portions of a pair of flexible wire leads 60*a*, 60*b* extending upwardly and outwardly from said grooves to have long flexible extensions 56*a*, 56*b* outside of cap 35. The wire leads 60*a*, 60*b* comprise central elongated electrical conductors 61*a*, 61*b* of copper (or other metallic material) and insulative jackets 62*a*, 62*b* around such conductors. As shown (FIG. 1) the outer ends of the leads may conveniently carry spade terminals 63*a*, 63*b* electrically connected to the conductors in the leads.

Figure 10:
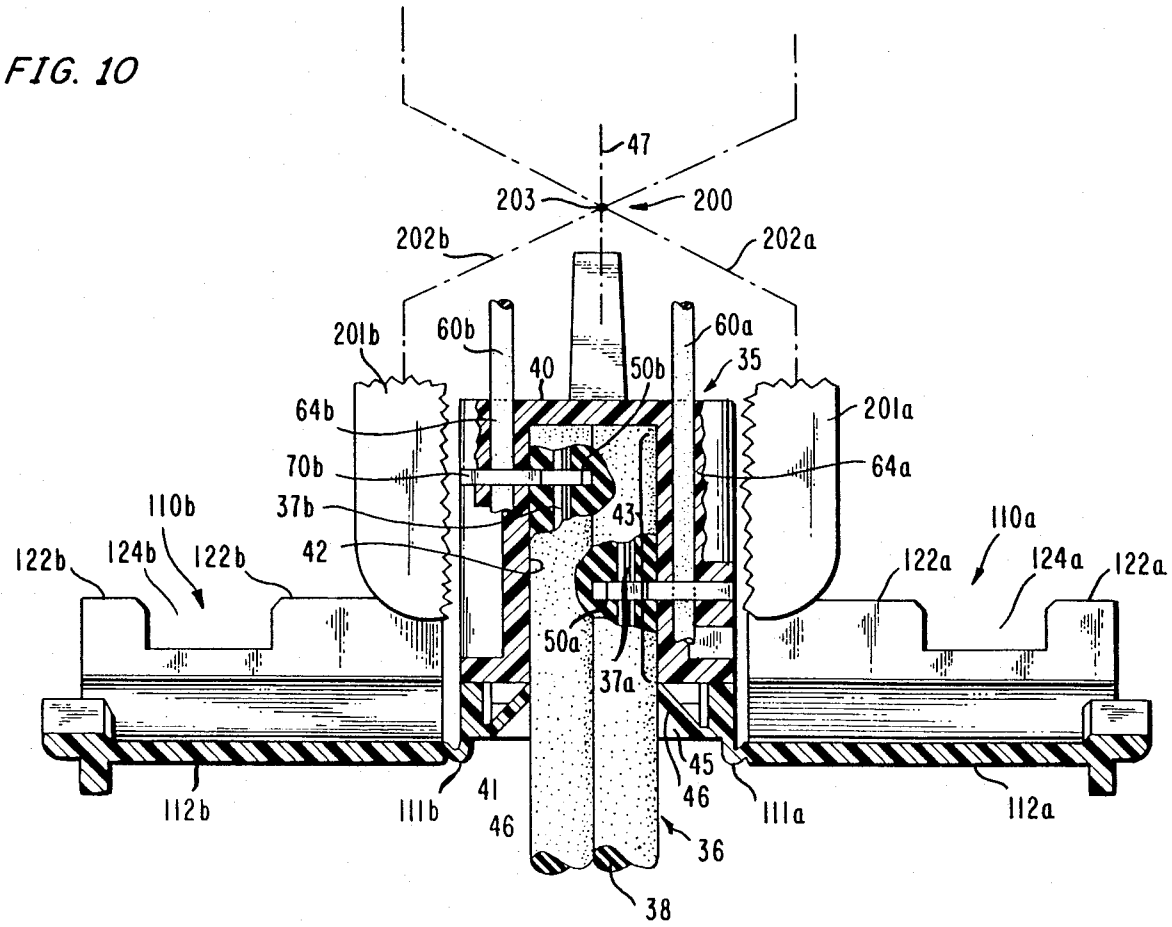
FIG. 10 is a front elevation of the FIG. 1 device (done partly in cross-section to show features of such device) and of a pliers tool for operating it.

Initially, the lower portions of the leads 60 are received loosely within their grooves 55 with the bottoms of the leads being received below the bottom surface of slots 50 in recesses 57*a*, 57*b* formed in the body of the cap 35. After, however, these lower portions have been so received, a heating tool is applied to cap 35 to cause plastic material of the cap adjacent the portions of the leads within those grooves 55 and recesses 57 to first melt and fuse to those portions around their peripheries, and to then reharden so as to bond those lead portions to the cap 35. FIG. 10 depicts some portions 64*a*, 64*b* of such fused and rehardened cap material which bonds portions of the leads 60 in the grooves 55 to the cap 35.

The slots 50*a*, 50*b* are respective receptacles for a pair of contacts 70*a*, 70*b* which are duplicates of each other so that only contact 70*a* need be described in full detail. Referring to FIGS. 1, 8, 9 and 11, contact 70*a* comprises an electrically conductive sheet metal piece 71*a* of copper (or other metallic material) having laterally separated front and back ends 72*a*, 73*a* and a pair of substantially straight parallel edges or margins 74*a*, 75*a* on transversely opposite sides of such piece and disposed between such back and front ends. With contact 70*a* being seated in slot 50*a*, the back and front ends of the contact are, respectively, it's inner and outer ends.

The contact 70*a* has at its inner end a pair of laterally extending major tines 81*a*, 82*a* on transversely opposite sides of, and equidistant from, the laterally running central axis 80*a* for that contact. Outside of and on transversely opposite sides of that pair of major tines are a pair of minor laterally extending tines 83*a*, 84*a* equidistant from axis 80*a*. The major tines 81*a*, 82*a* contain between them a transversely central notch 85*a* laterally extending into contact 70*a* from its inner end and V-shaped in the sense that the entrance 86*a* of that notch has a taper of "V" form which is divergent towards such end. Entrance 86*a* is bordered on its sides 87*a*, 88*a* by cutting edges thereon permitting such sides to pierce insulation.

Major tine 81*a* and minor tine 83*a* define between therein a notch 89*a* to one transverse side of central notch 85*a* and similar thereto in that notch 89*a* laterally extends into contact 70*a* from its front end inward and, moreover, has a "V" entrance 90*a* with a taper diverging towards such end. Entrance 90*a* is bordered by sides 91*a*, 92*a* with cutting edges thereon. These two sides accordingly are adapted to act as blades for piercing insulation. Notch 89*a* is, as shown, smaller in size than notch 85*a*.

The central notch 85*a* is flanked on its other transverse side by a smaller notch 93*a* defined between major tine 82*a* and minor tine 84*a*. Notch 93*a* is a mirror image of notch 89*a* and comprises the elements of a "V" entrance 94*a* and sides therefor 95*a*, 96*a* with cutting edges on such sides. Those elements of notch 93*a* are structural and functional counterparts of, respectively, the elements 90*a*, 91*a* and 92*a* of notch 89*a*.

The parallel sides 74*a*, 75*a* of contact 70*a* have thereon at the front of the contact a pair of projections 100*a*, 101*a* transversely salient from, respectively, those two side edges, and having the same positioning lateral dimension of the contact. The projections 100*a*, 101*a* constitute spurs having inclined edges 102*a*, 103*a* extending outwardly and backward to shoulders 104*a*, 105*a* on the spurs. To the rear of projections 100, 101*a*, the sides 74*a*, 75*a* of contact 70*a* have thereon another pair of projections 106*a*, 107*a* transversely salient from respective ones of those sides and directly opposite each other, laterally speaking. Elements 106*a*, 107*a* constitute stops with respective forwrad facing shoulders 108*a*, 109*a* thereon. The functions of the spurs 100*a*, 101*a* and the stops 106*a*, 107*a* will be later explained.

Figure 8:
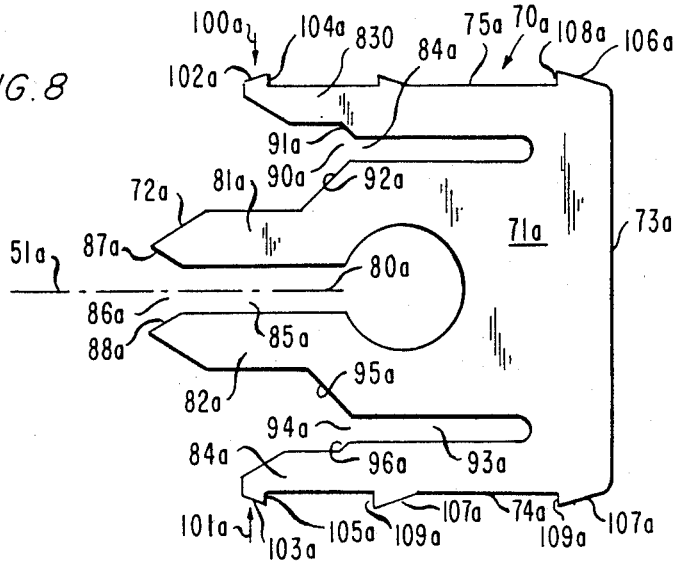
FIG. 8 is an enlarged plan view of the right hand contact of the FIG. 1 device in separated relation from the rest of such device.

As well shown in FIG. 8, the contact 70*a* is axially symmetrical about its laterall axis 80*a*, so it is a matter of indifference whether such contact is placed right side up or upside down in its slot 50*a* in the cap 35 (FIG. 1). Contact 70*b* is likewise axially symmetrical about its lateral axis 80*b* and is otherwise a duplicate of contact 70*a*. Hence, it is true also for contact 70*b* that it may be indifferently placed right side up or upside down in its slot 50*b* in the cap. The lateral axes 80 of the contacts 70 are coincident with each other and with the lateral axes 51 of the slots 50.

When either of contacts 70*a*, 70*b* is in retracted position in its receptacle slot 50*a*, 50*b*, a large portion of the entire contact projects outward of the outside of cap 35 so as, without more, to be fully exposed to the exterior environment of the cap. Moreover, even when the contacts 70 are disposed in forward position within their slots 50 (FIG. 10), there are portions of the outer ends of the contacts which continue to remain exposed to such exterior environment. That exposure is not desirable because of creating a substantial risk of unwanted grounding or shorting of the contact by possibly being accidentally contacted by some external conductive part. Moreover, such exposure increases the susceptibility of the contact to weathering or to other corrosion by agents in the environments.

To reduce, therefore, the deleterious effects resulting from exposure of contact 70 to the external environment, the connector 20 comprises a pair of insulative covers 110*a*, 110*b* disposed on laterally opposite sides of the cap or holder 35 to each be outside a respective one of the two contacts. The covers 110 are made of the same material as cap 35 and are connected at their bottoms to laterally opposite sides of the base 41 of cap 35 by flexible linear transversely-running laterally-spaced synthetic resinous parallel hinges 111*a*, 111*b* (FIG. 2) to thereby be integral with the rest of the plastic assembly 25. Since the covers 110*a*, 110*b* are duplicates of each other, only the cover 110*a* will be described in full detail.

Cover 110*a* is in the form of a thin walled shell 112*a* coupled at its bottom by hinge 111*a* to cap 35 to be movable between on open position (FIG. 1) and a closed position (FIG. 12) at which the portion of contact 70*a* exposed on the outside of cap 35 is, respectively, unenclosed and closed by the cover. Shell 112*a* is of arcuate cross-section in planes which are lateral-transverse (for the closed position of the cover) such that, when both of covers 110 are closed, their shells 112*a*, 112*a* are of concave shape in relation to each other and from a circumferentially discontinuous housing 115 (FIG. 12) around cap 35. Housing 115 in general shape approximates the form of a hollow split cylinder (or, alternatively, hexagonal prism) constituted of two semicylindrical (or prismatic) halves provided by the shells 112*a*, 112*b* of the covers 110*a*, 110*b*.

The shell 112*a* comprises a central panel 116*a* and side panels 117*a*, 118*a* on transversely opposite sides of the central panel. Panel 116*a* is coupled at its bottom to the hinge 111*a*. The side panels 117*a*, 118*a* are, however, not coupled to that hinge but, rather, are made integral with the rest of assembly 25 only by virtue of their joinder with the central panel along the edges of the two side panels contiguous therewith. The lack of coupling of the bottoms of the side panels of the shells 112 to the cap base 41 is a factor which, while permitting such shells to be mounted by such base 41 (through hinges 111 and the covers' central panels) also permits the arcuate shells while so mounted to be swung from their open positions around the linear hinges 111 to come together to approximate the cylindrical form characterizing the housing 115 when the two shells are fully closed. Moreover, such lack of coupling permits the side panels of each shell to be resiliently deflectable towards and away from each other, particularly at the juncture lines of such side panels with the central panel of the shell.

Figure 14:
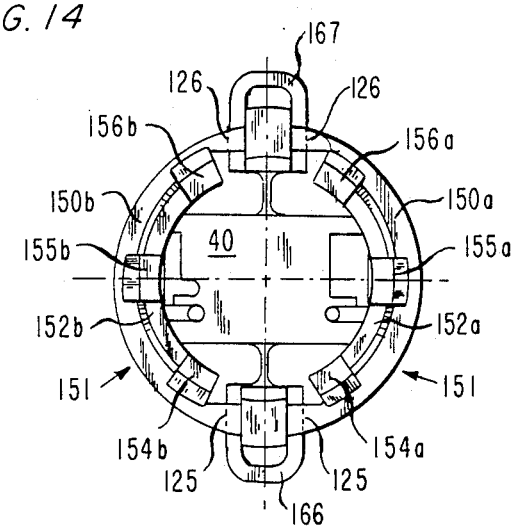
FIG. 14 is a top plan view of the plastic assembly of the FIG. 12 device.

The panels 117*a*, 118*a* are bordered at their margins away from central panel 116*a* by, respectively, edges 121*a*, 122*a* which are parallel with each other and with the axis (not shown) of the semicylindrical half approximated by shell 112*a*. The two edges 121*a*, 122*a* have respective semirectangular indentations 123*a*, 124*a* formed therein. When shells 112*a*, 112*b* are brought to closed position to define housing 115, the edges 121*a*, 121*b* are parallel to and register with each other with only a very slight gap between them, and the indentations 123*a*, 123*b* register with each other to define a rectangular port 125 (FIG. 14) in the housing. Contemperaneously, the edges 122*a*, 122*b* will similarly be in parallel and registering with each other and separated by only a small gap, and the indentations 123*b*, 124*b* will define another rectangular port 126 through housing 115.

The covers 110 are adapted to be locked to cap 35 by cover-retaining means comprising first and second detent means associated with, respectively, the cover 110*a* and the cover 110*b*. Such first detent means comprises a set of detent elements distributed between cover 110*a* and cap 35 to be in part on the former and in part on the latter. The detent elements on the cover consist (FIGS.

1 and 17), a pair of similar stubs 130*a*, 131 disposed towards the outer end of cover 110*a* on the interior of and on transversely opposite sides of the shell 112*a* to project radially inward from the inside walls of the side panels 117*a*, 118*a* of the shell. The stubs 130*a*, 131*a* on their laterally forward parts have respective bulges 132*a*, 133*a* causing the transverse distance between the two stubs at those bulges to be slightly less than the transverse distance between them rearward of such bulges. The shell 112*b* of cover 110*b* is equipped with similar stubs 130*b*, 131*b* with similar bulges 132*b*, 133*b* thereon.

Figure 17:
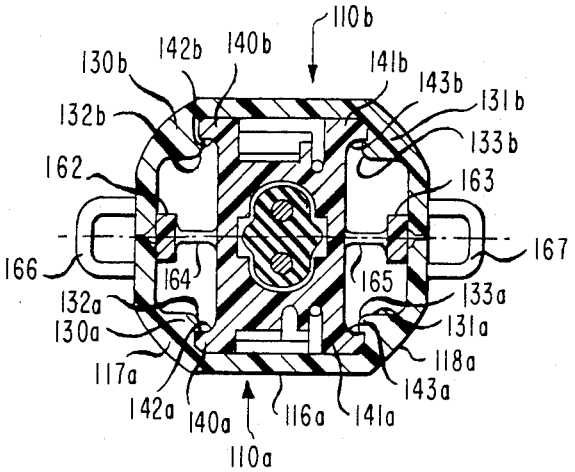
FIG. 17 is a view of the FIG. 16 assembly in horizontal cross-section taken as indicated by the arrows 17—17 in FIG. 16.

The cap 35 has thereon four bars 140*a*, 141*b*, 140*b*, 141*b* which are respective counterparts of the stubs 130*a*, 131*a*, 130*b*, 131*b*, and each of which bars is at one of the four corners of cap 35 and extends at such corner vertically most of the length of cap 35 to its top 40. The bars 140*a*, 141*a*, 140*b*, 141*b* on their sides away from the cover 110 nearest thereto have shoulders 142*a*, 143*a*, 142*b*, 143*b*. As will be evident from FIG. 17, bars 140*a* and 141*a* are detent elements which are respective counterparts of the detent elements or stubs 130*a*, 131*a*, and bars 140*b*, 141*b* are detent elements which are respective counterparts of the stubs 130*b*, 131*b*. Bars 140*b*, 141*b* and stubs 130*b*, 131*b* constitute the detent elements of the second detent means referred to earlier.

The covers 110*a*, 110*b* at the top of their shells have respective outward facing planar shoulders 150*a*, 150*b* which are of semiannular configuration and which are adapted upon bringing the covers to closed position to provide a split annular seating surface 151 for the connector 20. Disposed radially inwards of the shoulders 150*a*, 150*b* are respective neck portions 152*a*, 152*b* inset from those shoulders and projecting axially therefrom in the outward directions for the covers 110. When those covers are brought to closed position to provide the housing 115 for the cap 35, the two neck portions 152 cooperate to form a discontinuous annular neck 153 for such housing at its top. Neck portion 152*a* carries on its top rim a plurality of angularly spaced catches 154*a*, 155*a*, 156*a* overhanging shoulder 150*a*. Neck portion 152*b* has similar catches 154*b*, 155*b*, 156*b* overhanging shoulder 150*b*.

Figure 6:
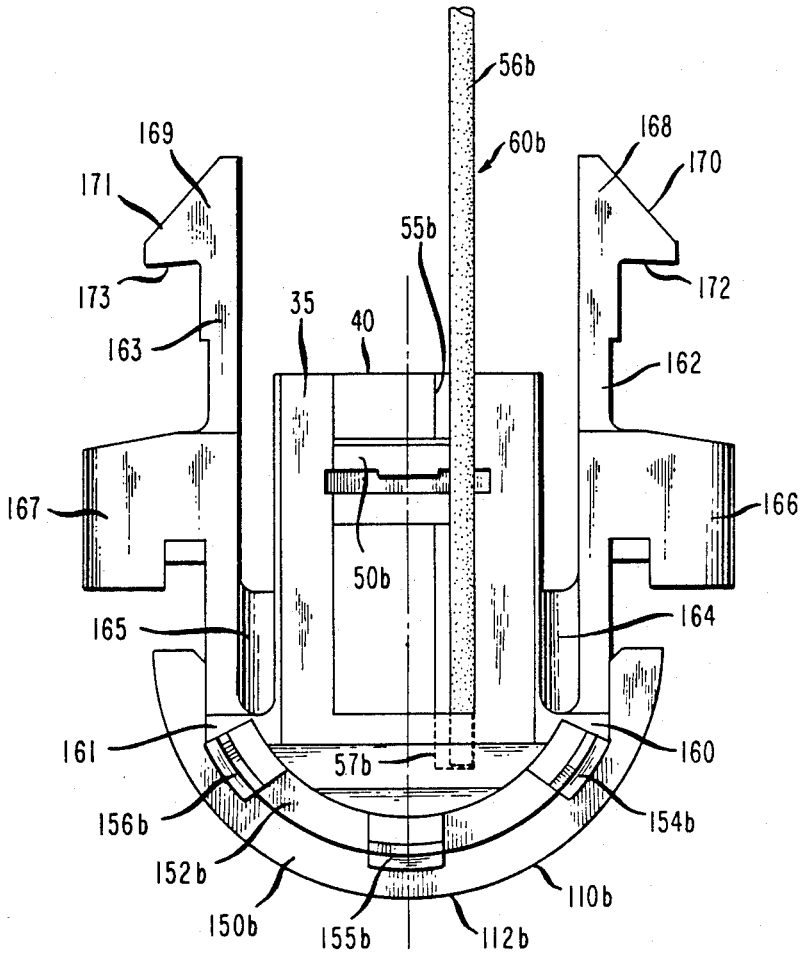
FIG. 6 is a left side elevation of the FIG. 1 device.
Figure 7:
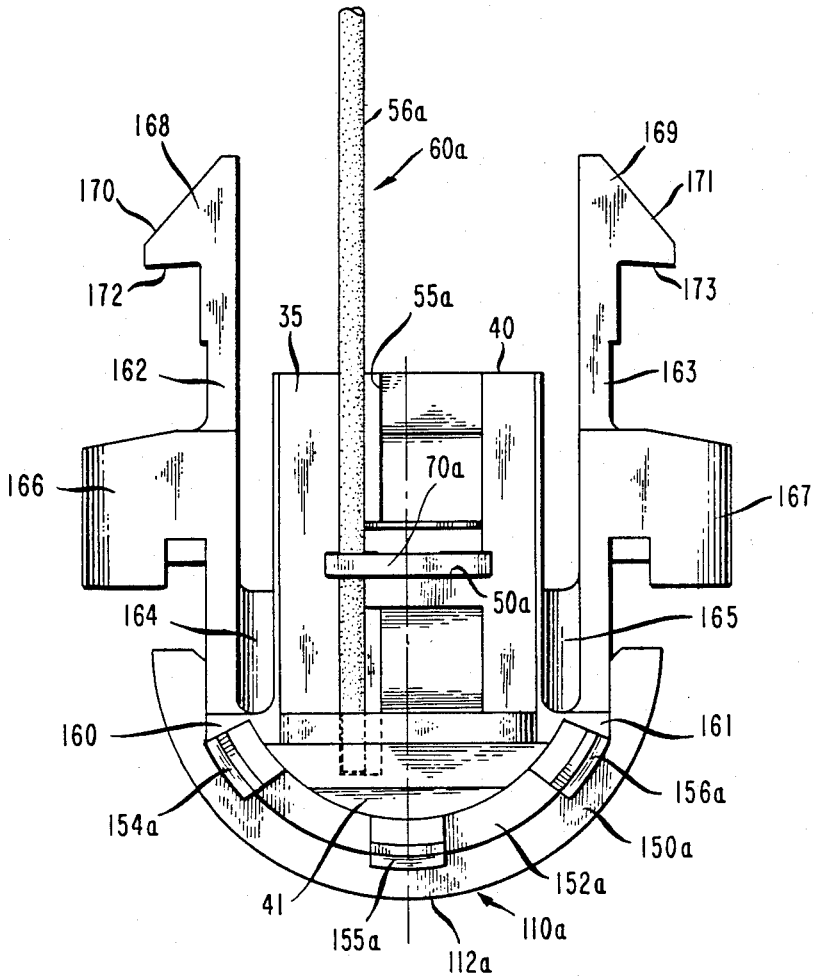
FIG. 7 is a right side elevation of the FIG. 1 device.

The holder 35 is transversely enlarged a short distance up from its base 41 by two flanges 160, 161 (FIGS. 1, 6, 7) transversely salient in opposite directions from the main body of the holder. Upstanding from the flanges 160, 161, respectively are a pair of latching fingers 162, 163 joined just above such flanges to the body of cap 35 by plastic webs 164, 165. Above those webs, the fingers 162, 163 carry respective buttons 166, 167 which are of "U" shape in the horizontal plane (FIG. 2). At their top, the fingers 162, 163 have barbs 168, 169 characterized by wedging faces 170, 171 sloping downward and outward from the tops of such fingers to transversely-salient downward-facing shoulders 172, 173 on the undersides of such barbs.

The fingers 162, 163 are resiliently defectable towards and away from each other. Because they are joined to holder 35 near its base and are concurrently spaced away from the holder above webs 164, 165, the fingers are longer resilient "beams" than they would be if connected to holder 35 at its top and, therefor, are more pliant than they would be if so connected to such top.

Figure 13:
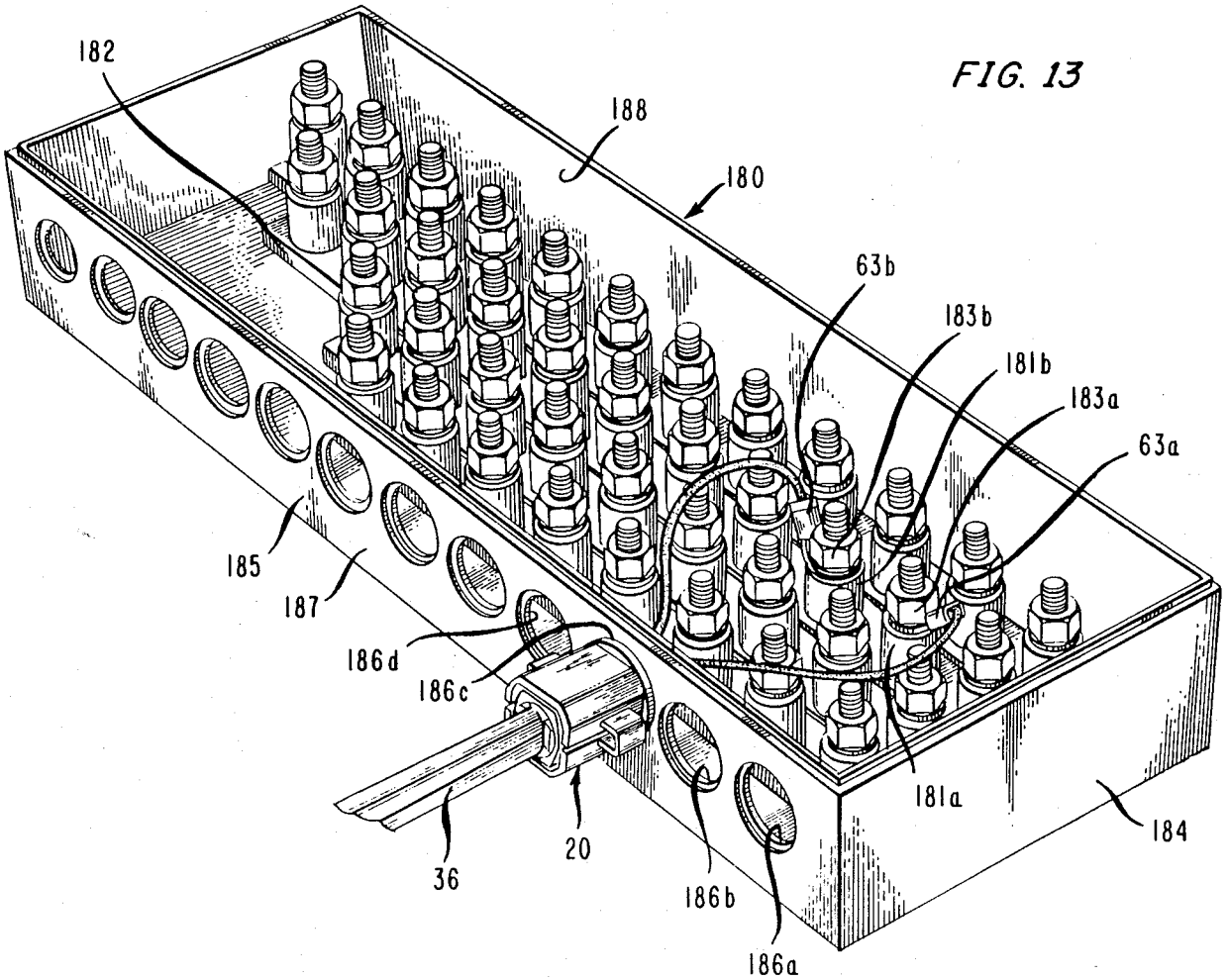
FIG. 13 is an isometric view of the FIG. 12 device in assembled relation with a terminal box.

Referring now to FIG. 13, the described electrical connector 20 is designed to cooperate with a terminal box 180 adapted to be mounted on the outside of a building (not shown) or other premises to the end of providing telephone service thereto. Box 180 comprises a plurality of threaded metallic binding posts 181 upstanding from an insulative base 182 and carrying respective binding nuts 183. The assembly of such base, posts and nuts is fixedly mounted on the floor of a rectangular boxlike casing 184 which, for convenience, is shown as being open at its top, but which, in practice, has its top closed by a lid (not shown). The front wall 185 of casing 184 is perforated by a row of circular apertures 186*a*, 186*b*, 186*c*, 186*d*, . . . passing through the front wall 185 of casing 184 from its outer wall surface 187 to its inner wall surface 188. Such apertures are adapted to provide entry for various cables and wires to the interior of the terminal box 180. When the box is in use, any of such apertures not utilized to provide such entry are closed by plugs (not shown). In practice, the terminal box is adapted to provide a substantially weatherproof receptacle for the elements therein and the electrical connections made by such elements.

Operation and Use of Embodiment

The described electrical connector 20 is operated and used in a manner as follows.

Before being put into use, the connector is in the condition generally shown in FIG. 1 in which the covers 110 are swung down to full open position. As earlier discussed, each of the wire leads 60 has portions both above and below, the associated slot 50 which are bonded to the body of cap 35 by material of such body fused to such portions. The leads 60 are thus permanently affixed to plastic assembly 25. The upper section 43 of channel 42 is filled with waterproof jelly 39, and while such jelly is shown in FIG. 3 as being in upper piece 27 before joinder thereof to lower piece 28, ordinarily the jelly would be added after pieces 27 and 28 have been fused together. Contact 70*a* is disposed in retracted position in its slot 50*a* and (as a difference from the FIG. 1 showing) contact 70*b* is likewise in retracted position in its slot 70*b*.

Figure 9:
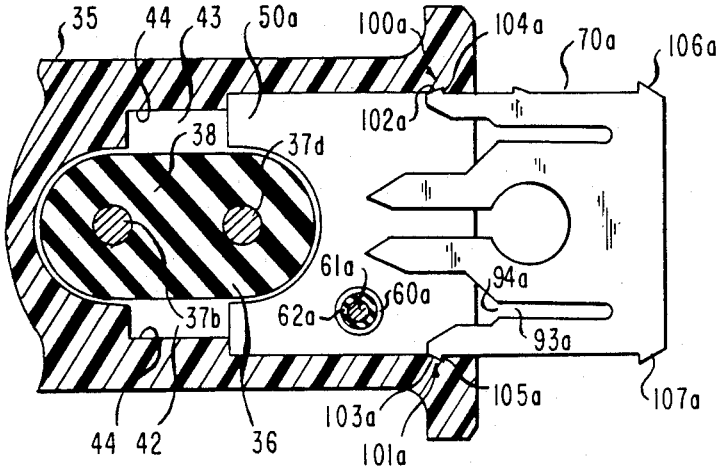
FIG. 9 is an enlarged fragmentary horizontal cross section, taken as indicated by the arrows 9-9 in FIG. 5, of the portion of the FIG. 1 device which includes the receptacle slot for the FIG. 8 contact, such contact being shown in FIG. 9 in retracted position in such slot.
Figure 11:
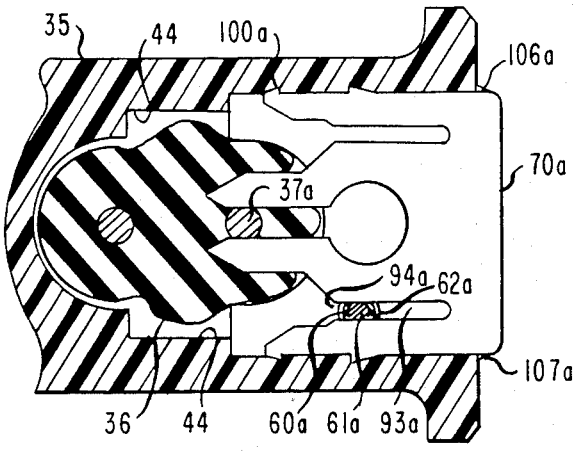
FIG. 11 is an enlarged fragmentary horizontal cross-section of the same portion of the FIG. 1 device as is shown in FIG. 9 with, however, the contact being shown in FIG. 11 in forward position within its receptacle slot.

FIG. 9 shows details of such position for contact 70*a*. It will be noted from FIG. 9 that, when the contact is in that position the spurs 100*a*, 101*a* of the contact are disposed a short distance into the slot from its entrance, the spurs having been so positioned by advancing contact 70*a* into the slot with moderate force. In the course of such advancement, the inclined forward faces 102*a*, 103*a* of the spurs abrade and score the side walls of slot 50*a* and cause some of the material of such walls to accumulate behind the rearward facing shoulders 104*a*, 105*a* of such spurs. Thereupon, the spurs of contact 70*a* serve as detents to hold it stationary in retracted position against casual forces tending to move the contact. Contact 70*b* is stabilized by its spurs in retracted position in the same manner.

As a first step in operating the the connector, a free end of the drop wire 36 is placed below the base 41 of cap 35 and is then pushed upwardly into the vertical channel 42 in the cap. As the drop wire passes through the lower section 45 of the channel, the wires' free end presses upwardly against the inner ends of the tabs 46 extending into the channel. That pressing resiliently deflects those tab ends upwards until the opening therebetween is large enough that such free end and a following part of the drop wire can and does slide past the tabs. The larger radial size of section 45 than of section 43 permits tabs 47 to be longer and thus more easily deflected (an advantage) than would otherwise be the case. With the tabs being so deflected to slant upwardly in the radially inner direction in channel 42 and to be maintained (as they are) in engagement with the outside of drop wire 36, the tabs serve as a strain reliever against pulls on the drop wire tending to separate it from assembly 25.

After the free end of the drop wire has transversed lower section 45 of the channel 42, it is advanced unto the upper section 43 of the channel and, in the course of doing so, displaces most of the waterproofing jelly 39 in that upper section. Some of such displaced jelly is driven into the slots 50 to provide waterproofing for the contacts 70 therein. Advancement of the drop wire into the channel is stopped when the free end of the wire reaches the top of upper section 43.

That section 43 has a horizontal cross-section which is of a non-circular shape matching that the drop wire in such cross-section, and which is of a size just enough greater than that of the drop wire so that it is received in the section with a close sliding fit. Because of such shape and size of the section relative to that of the drop wire, the section precludes any significant angular shifting or play in the horizontal plane of the drop wire relative to cap 35. Accordingly, by virtue of its being so fixed in its angular disposition in the horizontal plane relative to the cap, the drop wire 36 is maintained properly positioned at all times relative to the contacts 70*a*.

The next step in the operation of connector 20 is to apply to cap 35 a pliers tool 200 (FIG. 10) having jaws 201*a*, 201*b* and handles 202*a*, 202*b* respectively coupled to these two jaws and pivotally coupled together at pivot point 203. For the purposes of such application, the tool 200 is positioned relative to the cap as shown in FIG. 10 with the jaws 201*a*, 201*b* being on laterally opposite sides of the cap to face inwards towards the outer ends of, respectively, the contacts 70*a* and 70*b*, handles 202 being above cap 35, pivot point 203 lying along the axis 47 of channel 42, and tool 200 being disposed symmetrically about such axis and in the vertical-lateral midplane of the channel 42 and cap 35. Once the tool is so positioned, it is operated by gripping in one hand the upper parts of the handles 200 and then manually squeezing those upper parts to draw them towards each other. In response, the jaws 200 of the tool first engage with the outer ends of contacts 70 (which outer ends are commonly intersected by said plane to permit such concurrent engagement by said jaws) and then drive said engaged contacts inward in their slots 50 in cap 35 from their initial retracted positions in such slots to their forward positions therein, such two positions for contact 70*a* being shown in, respectively, FIG. 9 and FIG. 11. A first effect of such driving inward of contact 70*a* is that the portion of wire lead 60*a* disposed in the vertical extent of slot 50*a* is received into the entrance 94*a* of notch 93*a* in contact 70*a* so that the shart sides 95*a*, 96*a* flanking that entrance pierce the insulation 62*a* of such lead and engage with the conductor 61*a* of the lead to make electromechanical contact therewith.

A second effect of such driving is that, within the vertical extent of drop wire 36 registering with that of slot 50*a*, a portion of such drop wire towards contact 70*a* is received into the entrance 86*a* of notch 85*a* in that contact so that the cutting sides 87*a*, 88*a* of that notch pierce the insulation 38 of the drop wire to make electromechanical contact with the conductor 37*a* therein. As the tines 81*a*, 82*a* of the contact 70*a* drive into the insulation of the drop wire, some of that insulation is deformed and displaced into the grooves 44 in channel section 43 to make room for further penetration of such insulation by the contact.

With contact 70*a* being in electromechanical contact with both the conductor 61*a* of lead 60*a* and the conductor 37*a* of the drop wire, the contact (being in itself adapted to conduct electric current) provides an electrical connection between those two conductors. In similar fashion the inward driving of contact 70*b* results in an electromechanical contact thereof with both conductor 61*b* in lead 60*b* and conductor 37*b* in drop wire 36 and a resulting electrical connection by that contact of thosee two latter conductors.

Some advantages in the connecting up of the conductors of the drop wire by the use of connector 20 as so far described as follows.

Because connector 20 caps the free end of the drop wire received therein, and the contacts 70 in that connector are on radially opposite sides of such received end and their outer ends are intersected by the same lateral-vertical plane, it is possible for a pliers tool 200 to be positioned as shown in FIG. 10 and, by the single squeezing towards each other of the plier handles, to drive both contacts inward to effect the desired respective electrical connections of both of the conductors in the drop wire.

The contacts 70 are initially separated in connector 20 from the drop wire inserted therein in the direction of spacing from each other of the two conductors in the drop wire. Also, the inward driving of each such contact is in that same direction. The vertical length of drop wire accomodated in the slot receiving that contact is thus less susceptible to being bent by the driving of the contact against it than it would be if the driving direction of the contact were normal to the direction of spacing of the conductors in the drop wire. That extra stiffness of such drop wire length is of aid in securing the piercing of the drop wire insulation by the contact and the making of reliable electrical contact between such contact and the near conductor of the drop wire.

The vertical spacing of the slots 50 promotes that stiffness in that in each slot the drop wire on its side away from the contact is backed by the solid material of the cap 35. Moreover, such vertical spacing prevents inadvertent engagement between the contacts in the slots.

Moreover, the initial positioning of each contact away from the drop wire in the direction of spacing of the conductors therein provides the additional advantages that, as such contact is driven inward from such initial positioning towards and into engagement with the near conductor of the drop wire, both of the major tines of the contact remain further from the other drop wire conductor than one of such tines would be if the direction of such initial positioning and subsequent inward driving were to be normal to the spacing between the drop wire conductors. Hence, there is less risk that one of such tines might inadvertently make contact with the wrong one of such conductors.

The ruggedness of the electromechanical contacts made between the contacts 70 and drop wire conductors 37 is enhanced by the action of the described tabs 46 in that such tabs provide strain relief against such electromechanical contacts being disrupted by a pulling force on the drop wire.

Turning now to the leads 60, that the vertical lengths of such leads in slots 50 are bonded above and below such slots to the body of cap 36 is a factor which greatly increases the stiffness of such lengths and, accordingly facilitates the actions of the contacts 70 in piercing the insulation of such leads and making electromechanical contact with the conductors therein. Moreover, the fact that such leads are so bonded to cap 35 above slots 50 provides strain relief against such electromechanical contacts being disrupted by pulling force on the leads.

At the ends of the inward driving of contact 70*a*, the shoulders 108*a*, 109*a* on stops 106*a*, 107*a* engage with the outside surface of cap 35 to define the forward position of the contact. Further inward movement of contact 70*a* will be resisted by such stops while outward movement of the contacts will be resisted by the engagement of spurs 100, 101*a* thereon with the side walls of slot 50*a*. Contact 70*a* is thus stabilized in a predetermined forward position therefor. A similar stabilizing is provided for the contact 70*b* by the stops 106*b*, 107*b* and spurs 100*b*, 101*b* thereon.

Figure 12:
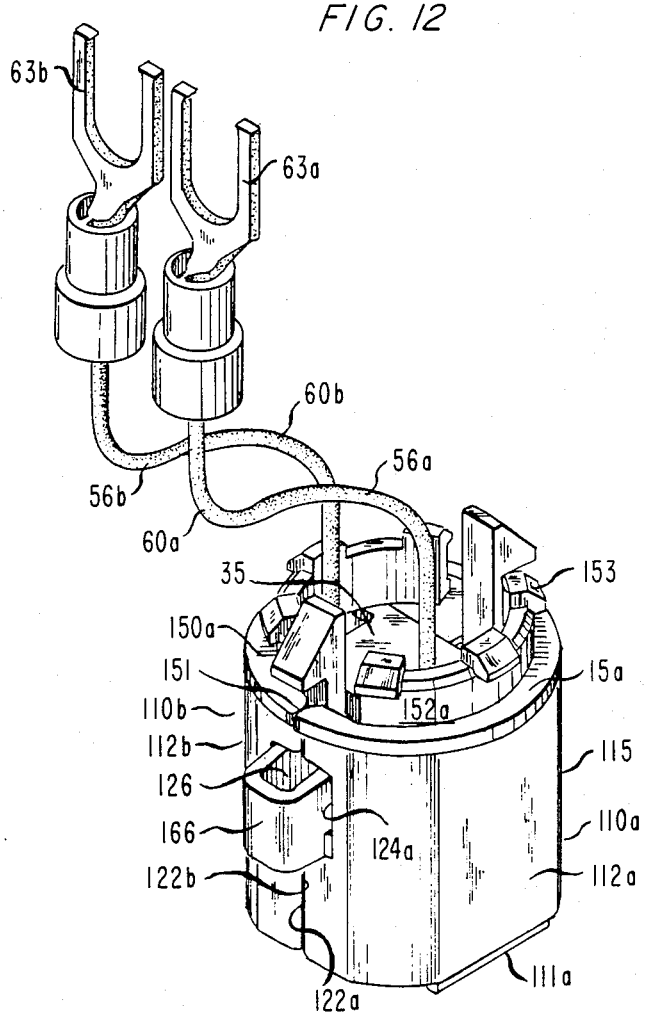
FIG. 12 is an isometric view of the FIG. 1 device with its covers being in closed position.

With both of the contacts 70 being disposed in their forward position in the cap 35, cover 110*a* is swung upward around its flexible hinge 111*a* from its full open position (FIG. 1) to its full closed position (FIG. 12). In the course of such movement of the cover, the bulges 132*a*, 133*a* on the stubs 130*a*, 131*a* at the top of cover 110*a* will come into contact with bars 140*a*, 141*a* on cap 35 (FIG. 17) and be wedged transversely outward by such bars to permit the bulges to ride in the lateral direction over the bar surfaces. That outward wedging of the bulges is made possible by the fact that the side panels 117*a*, 118*a* of cover 110*a* are resiliently deflectable and do indeed deflect away from each other to accommodate such wedging. After the bulges 132*a*, 133*a* have laterally passed by bars 140, 141*a*, the bulges snap transversely inward laterally behind the shoulders 142*a*, 143*a* of such bars (with concurrent restoration of such side panels to undeflected position) so as, by that snap action, to maintain the cover 110*a* locked to cap 35. The stubs 130*b*, 131*b* on cover 110*b* and the bars 140*b*, 141*b* on cap 35 cooperate in a similar way by snap action to lock cover 110*b* to the cap. With both covers being closed, the connector 20 itself will appear as shown in FIG. 12, (the drop wire being omitted from that view) with the buttoms 166, 167 on the latching 162, 163 passing through the ports 125, 126 in housing 115 to project outwardly therefrom.

Having brought matters to the stage described, the flexible extensions 56 of leads 60 of the connector 20 are passed through the aperture 186*c* in the front wall 185 of the casing 184 of terminal box 180. Then, the outer ends of the latching fingers 162, 163 are inserted into the aperture to produce engagement between the side wall of aperture 186*c* of casing 184 and the slanted faces 170, 171 on the barbs 168, 169 of such fingers and, thereafter, resilient deflection of such fingers and wedging of such barbs towards each other to permit them to pass through the aperture. Concurrently, the neck portions 152 on the connector are forced into aperture 186*c* and are resiliently strained to permit the catches 154, 155, 156 on the rims of such neck portions to enter the aperture and pass to the inner side 188 of front wall 185 of casing 184 of the terminal box. At the end of the foregoing actions, the outer end of the connector is advanced into the aperture until it will go no further.

Figure 15:
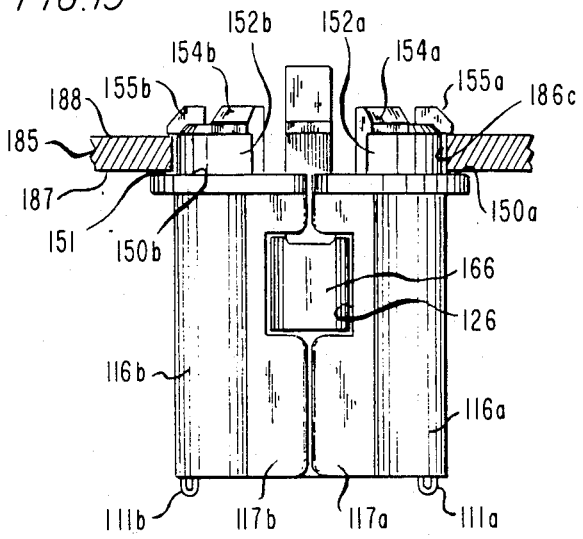
FIG. 15 is a front elevation of the FIG. 14 assembly in assembled relation with a portion (shown in fragmentary cross section) of the FIG. 13 box.
Figure 16:
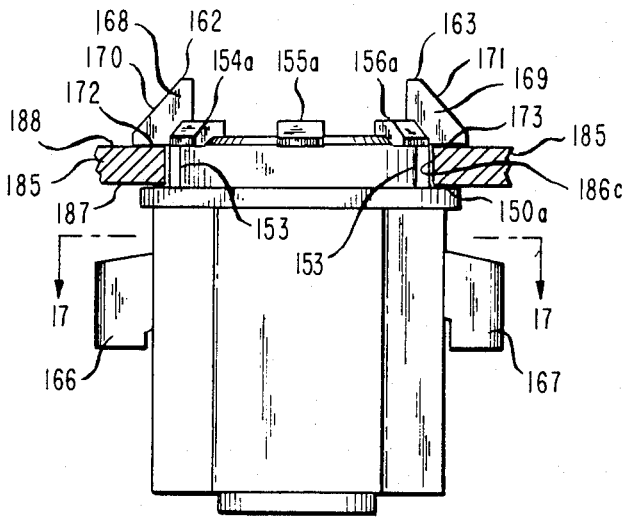
FIG. 16 is a right side elevation of the FIG. 14 assembly and of such portion (shown in cross section) of such box.

When the connector is fully received in aperture 186*c*, the outer side 188 of terminal box casing 184 rests against the split annular seating 152 provided for connector 20 by the semiannular shoulders 150*a*, 150*b* at its top (FIGS. 15 and 16). Further, latching fingers 162, 163 have sprung back to their undeflected positions to cause barbs 168, 169 to bear by their shoulders 172, 173 against the inner wall surface 188 of the terminal box casing (FIG. 16). Still further the catches 154, 155, 156 on the inserted neck portions 152 likewise bear on that inner wall surface (FIG. 15). The effect of such bearing by such barbs and catches is to produce a firm pressure contact of the flat seat 151 on the connector against the outer wall surface 187 of the terminal wall casing. Also, the neck portions 152*a*, 152*b* on connector 20 make a close fit with the circumferential wall bounding aperture 186*c*. Accordingly, connector 20 as shown in FIG. 13 is firmly attached to terminal box 180 and provides a closure for aperture 186*c* which is reasonably weathertight.

Having attached the connector to the terminal box as described above, the drop wire installation is completed by placing the spade terminals 63*a*, 63*b* on selected binding posts 181*a*, 181*b* in the terminal box 180 and by then screwing down the binding nuts 183*a*, 183*b* on such posts to secure such spade terminals thereto.

If desired, the connector 20 can later be detached from box 180 by disconnecting such spade terminals from such posts, pressing buttons 166, 167 on the connector 20 to deflect latching fingers 162, 163 inward to permit the barbs 168, 169 thereon to pass in the reverse direction through aperture 186*c*, and concurrently rocking the outer end of the connector in such aperture to cause the catches 154, 155, 156 on the connector to release from the inner wall surface 188 of the terminal box casing 184 and pass through such aperture.

The above described embodiment being exemplary only, it will be understood that additions thereto, omissions therefrom and modifications thereof can be made without departing from the spirit of the invention, and that, accordingly, the invention is not to be considered as limited save as is consonant with the scope of the following claims.

What is claimed is:

1. A connector for a wire comprising a pair of spaced conductors and an insulative jacket around them and of greater lateral than transverse dimension in cross-section, said connector comprising:

a synthetic resinous cap having a vertically spaced top and base and having extending thereinto from said base a vertical channel into which a free end of said wire is insertable, said channel of fixed size and shape horizontally being of greater lateral than transverse dimension and of a non-circular cross-section adapted to fit around said wire when inserted to restrict angular rotation thereof relative to said cap, and said cap having formed therein a pair of slots on laterally opposite sides of said channel and passing from outer openings of such slots on the outside of said cap to respective inner openings of said slots into said channel, a pair of metal contacts respectively received in said slots and having shaped inner ends adapted upon inward driving of said contacts into said slots to pierce the insulation of said inserted wire to make electromechanical contact with respective ones of the conductors thereof, and a pair of electrical leads each comprising a conductor and insulation therefor and having their bottom ends disposed adjacent said contacts to permit connection at such ends of their respective conductors to, respectively, one and the other of said contacts, said leads extending from such ends thereof away from said cap to permit electrical connection of said conductors of said wire via said leads to external terminals.

2. A connector as in claim 1 in which said contacts have respective outer ends each initially projecting outward of said cap's outside and adapted to have the jaws of a pliers tool concurrently engage the outer ends of both such contacts to concurrently drive them both inward into said slots to pierce the insulation of said wire and contact its conductors.

3. A connector as in claim 1 in which lower portions of said leads are initially inserted in respective ones of a pair of vertical grooves above and below said openings formed in the outside of said cap to extend upward from respective ones of said outer openings of said slots to top openings of said grooves, and in which such inserted lower lead portions are fused in said grooves with the material of said cap to thereby provide strain relief for connections made between said contacts and the conductors of said leads.

4. A connector for a wire comprising a pair of spaced conductors and an insulative jacket around them and of greater lateral than transverse dimension in cross-section, said connector comprising:

a synthetic resinous cap having a vertically spaced top and base and having extending thereinto from said base a vertical channel into which a free end of said wire is insertable, said channel horizontally being of greater lateral than transverse dimension and of a non-circular cross-section adapted to fit around said wire when inserted to restrict angular rotation thereof relative to said cap, and said cap having formed therein a pair of slots on laterally opposite sides of said channel and passing from outer openings of such slots on the outside of said cap to respective inner openings of said slots into said channel, a pair of metal contacts respectively received in said slots and having shaped inner ends adapted upon inward driving of said contacts into said slots to pierce the insulation of said inserted wire to make electromechanical contact with respective ones of the conductors thereof, and a pair of electrical leads each comprising a conductor and insulation therefor and having their bottom ends disposed adjacent said contacts to permit connection at such ends of their respective conductors to, respectively, one and the other of said contacts, said leads extending from such ends thereof away from said cap to permit electrical connection of said conductors of said wire via said leads to external terminals, said contacts each having at its inner end at least three tines providing therebetween at least two V-shaped notches diverging towards such ends and bordered on their sides by cutting edges formed on said tines, such two notches being relatively greater and smaller in size and being adapted to pierce the insulation of, respectively, said wire and a one of said leads.

5. A connector as in claim 4 in which said contacts each has at its inner end at least four tines providing therebetween at least three of said V-shaped notches, the middle of said notches being greater in size than the notches to either side thereof and being adapted to pierce the insulation of said wire, while either one of said other notches is adapted to pierce the insulation of the lead associated with that contact, each of such contacts accordingly being operable to effect both of such piercings while being positioned either right side up or upside down in the corresponding slot in said cap.

6. A connector for a wire comprising a pair of spaced conductors and an insulative jacket around them and of greater lateral than transverse dimension in cross-section, said connector comprising:

a synthetic resinous cap having a vertically spaced top and base and having extending thereinto from said base a vertical channel into which a free end of said wire is insertable, said channel horizontally being of greater lateral than transverse dimension and of a non-circular cross-section adapted to fit around said wire when inserted to restrict angular rotation thereof relative to said cap, and said cap having formed therein a pair of slots on laterally opposite sides of said channel and passing from outer openings of such slots on the outside of said cap to respective inner openings of said slots into said channel, a pair of metal contacts respectively received in said slots and having shaped inner ends adapted upon inward driving of said contacts into said slots to pierce the insulation of said inserted wire to make electromechanical contact with respective one of the conductors thereof, said contacts having outer ends of which portions thereof are exposed to the exterior environment of said cap, and a pair of electrical leads each comprising a conductor and insulation therefor and having their bottom ends disposed adjacent said contacts to permit connection at such ends of their respective conductors to, respectively, one and the other of said contacts, said leads extending from such ends thereof away from said cap to permit electrical connection of said conductors of said wire via said leads to external terminals and in which said connector further comprises a pair of insulative covers disposed on laterally opposite sides of said cap to each be outside a respective one of said contacts, each of such covers being hingedly connected to the base of said cap to be angularly movable relative thereto between an open position and a closed position for such cover at which the exposed portion of such contact is, respectively, unenclosed and enclosed by such cover, and cover-retaining means for locking both said covers in closed position when moved to that position.

7. A connector as in claim 6 in which said cover-retaining means comprises detent means respective to said covers and each distributed between said covers and cap so that each detent means comprises first elements carried by the cover respective to that means and second counterpart elements carried by said cap, each such first element and counterpart second element being adapted by snap-action to mutually engage and to thereupon releasably lock the corresponding cover to said cap.

8. A connector as in claim 7 in which at least one detent means comprises a pair of first detent elements disposed on the inside of the corresponding cover at its top on transversely opposite sides thereof, and a pair of second detent elements which are disposed on the outside of said cap at its top on transversely opposite sides thereof, and which are counterparts of said first detent elements, each such first detent element and its counterpart second detent element being adapted by snap-action to mutually engage and to thereupon releasably maintain such engagement.

9. A connector as in claim 6 in which said covers are synthetic resinous and have bottoms connected to laterally opposite sides of the base of said cap by flexible transversely running synthetic resinous hinges joining said cap and covers into an integral synthetic resinous assembly.

10. A connector as in claim 7 in which said covers comprise respective thin-walled shells which are connected at such bottoms to said cap by said hinges and which, for the closed positions of said covers, extend upward from said hinges, said shells having respective cross-sections in lateral transverse planes which are of concave shape in relation to each other so that said shells together form a circumferentially discontinuous housing around said cap.

11. A connector as in claim 8 in which said covers at the tops of said shells have respective neck portions which, for the closed positions of said covers, project upwards and are inset from the outside of said shells and cooperate with each other to together form a reduced-size circumferentially discontinuous neck for said housing, said neck being adapted to be received within an aperture formed in a casing for a terminal box.

12. A connector as in claim 11 in which said covers at the tops of said shells provide outwardly-facing shoulders which, for the closed positions of said covers, are disposed between said inset neck portions and the outside of said shells, and which shoulders are cooperable to together provide a seating surface for said connector.

13. A connector as in claim 12 in which said connector further comprises a plurality of latching fingers coupled to said cap and extending upwardly beyond said neck, and a plurality of barbs at the top ends of said fingers, and said fingers being resiliently deflectable towards each other to enable said barbs to pass through said aperture and then spring back to undeflected positions thereof at which said barbs engage surface portions of said casing on the inside thereof around said aperture to latch said fingers to said casing and thereby secure said connector to said casing with said neck of said connector being in said aperture.

14. A connector as in claim 13 in which said plurality of latching fingers consists of a pair of such fingers having bottom ends coupled to the base of said cap on transversely opposite sides thereof, and extending upwards from such bottom ends in transversely spaced relation from the outside of said cap and initially within said housing and then beyond it to position said barbs above said housing.

15. A connector as in claim 14 in which such two fingers have thereon respective buttons disposed thereon intermediate their top and bottom ends and transversely extending through ports therefor formed in said housing to project transversely outward of such housing, said buttons being adapted, when said connector is secured to said casing, to be manually pressed so as to unlatch said fingers from said casing and thereby facilitate removal of said connector therefrom.

16. A connector as in claim 12 in which the neck portions of each such cover each has on the rim thereof a plurality of catches overhanging the said shoulder of such cover, and in which said catches of said two covers are adapted to engage the inside of said casing around said aperture so as to hold the outside of said casing around said aperture in seated relation on said shoulders of said covers.

17. A connector according to claim 8 in which each shell comprises a central panel and two side panels, said central panel having its bottom coupled to the corresponding transversely running hinge for such shell, said side panels being integral with and on transversely opposite sides of said central panel and being susceptible to deflection relative to said central panel to vary the transverse distance between said side panels, the bottoms of said side panels being uncoupled from such hinge to facilitate such deflection of said side panels.

18. A connector as in claim 4 in which at least one of said contacts comprises a sheet metal piece having a pair of substantially straight parallel edges disposed on transversely opposite sides of such piece between the inner and outer ends thereof, and which contact includes at least one pair of projections integral with said piece and transversely salient from, respectively, one and the other of said pair of edges.

19. A connector as in claim 18 in which said projections constitute spurs forwardly pointing towards the inner end of said contact and adapted, when said contact is inserted in said slot, to impede removal of said contact therefrom.

20. A connector as in claim 18 in which said projections constitute stops adapted when such contact is inserted in its slot in said cap to bear against the outside of said cap as to so impede casual movement of said contact further into said slot.

21. A connector as in claim 18 in which said contact includes at least first and second pairs of projections integral with said piece, the projections in each pair being on transversely opposite sides of said piece so as to be transversely salient from one and the other of said edges, the projections in said first pair constituting spurs forwardly pointing towards the inner end of said contact and being adapted, when said contact is inserted in its slot in said cap, to impede removal of said contact from such slot, and said projections in said second pair constituting stops adapted, when said contact is so inserted, to impede casual movement of said contact further into said slot.

22. A connector for a drop wire comprising two separated conductors and insulation therefor, said connector comprising: an insulative holder for a free end of said drop wire, a pair of flexible elongated wire leads each comprising a conductor and insulation therefor and each having a first end proximate said holder and a second end attachable to a respective one of two terminals, and a pair of metal contact means movably received in said holder and each being disposed adjacent the first end of a respective one of said leads and being adapted by externally applied force on such contact means to be driven into said holder to pierce the insulation of said drop wire and to electrically interconnect the conductor of such lead and a respective one of the conductors of said drop wire.

23. A contact comprising, a sheet metal piece having laterally separated back and front ends and having formed therein at its front end a plurality of transversely spaced V-shaped notches diverging in the lateral direction towards said front end, said piece being adapted to be received with a transverse guiding fit in a slot formed in an insulative holder so that such piece when so received is laterally movable forward into said slot, said notches in said piece being of first and second different sizes adapted to receive therein respective wires of corresponding first and second different sizes and each comprising at least one conductor and insulation therefor, said notches, moreover, being each bordered on its sides by cutting edges adapted to pierce the insulation of the wire corresponding to that notch and to produce electrical contact between said conductor of such wire and said piece upon lateral movement of the latter into said slot, and said plurality notches being positioned in the transverse dimension of said piece so that there are notches of said first size and of said second size which occupy, respectively, first and second predetermined positions in the transverse dimension of said slot for, respectively, notches of said first size and of said second size, whether said piece is received right-side up or upside-down in said slot.

* * * * *